US008240892B2

(12) United States Patent
Wang

(10) Patent No.: US 8,240,892 B2
(45) Date of Patent: Aug. 14, 2012

(54) READING LIGHT

(75) Inventor: Pao-Ching Wang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 454 days.

(21) Appl. No.: 12/562,681

(22) Filed: Sep. 18, 2009

(65) Prior Publication Data

US 2011/0013407 A1 Jan. 20, 2011

(30) Foreign Application Priority Data

Jul. 17, 2009 (CN) ..... 2009 1 0304470

(51) Int. Cl.
*F21V 23/04* (2006.01)

(52) U.S. Cl. ..... 362/394; 362/295; 362/249.12; 362/646

(58) Field of Classification Search ..... 362/394, 362/295, 85, 411, 157, 184, 188, 189, 646, 362/234, 253, 249.12, 249.13
See application file for complete search history.

(56) References Cited

U.S. PATENT DOCUMENTS

| | | | | |
|---|---|---|---|---|
| 4,254,451 | A * | 3/1981 | Cochran, Jr. | 362/103 |
| 4,664,434 | A * | 5/1987 | Borst et al. | 294/87.1 |
| 4,992,912 | A * | 2/1991 | Lee | 362/86 |
| 7,086,767 | B2 * | 8/2006 | Sidwell et al. | 362/545 |
| 7,585,090 | B2 * | 9/2009 | Wu | 362/249.02 |
| 8,066,393 | B2 * | 11/2011 | Takahashi et al. | 362/97.1 |

* cited by examiner

*Primary Examiner* — Bao Q Truong

(74) *Attorney, Agent, or Firm* — Altis Law Group, Inc.

(57) ABSTRACT

A reading light includes a light emitting diode (LED) capable of emitting light, a transparent pressable member, and a flexible printed circuit board capable of connecting a power supply to the LED. When the pressable member is at a normal state, the flexible printed circuit is disconnects the LED from the power supply to power off the LED. When the pressable member is at a depressed state, the flexible printed circuit electrically connects the LED to the power supply to powered on the LED.

15 Claims, 3 Drawing Sheets

READING LIGHT

BACKGROUND

1. Technical Field

The present disclosure relates to reading lights, and more particularly to a reading light capable of being applied to a portable electronic device.

2. Description of Related Art

Reading lights are well known in the art. The reading lights may be independent portable devices, or adopted by vehicles or portable electronic devices, such as notebook computers, cell phones, radios, etc.

A typical reading light includes a transparent panel, one or more LEDs (light-emitting diode) disposed at an inner side of the transparent panel, and a power button. A user of the reading light is capable of actuating the power button to power on or off the reading light. However, the typical reading light includes electrical wires connecting the LEDs to a power supply, and a configuration of the typical reading light is intricate.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
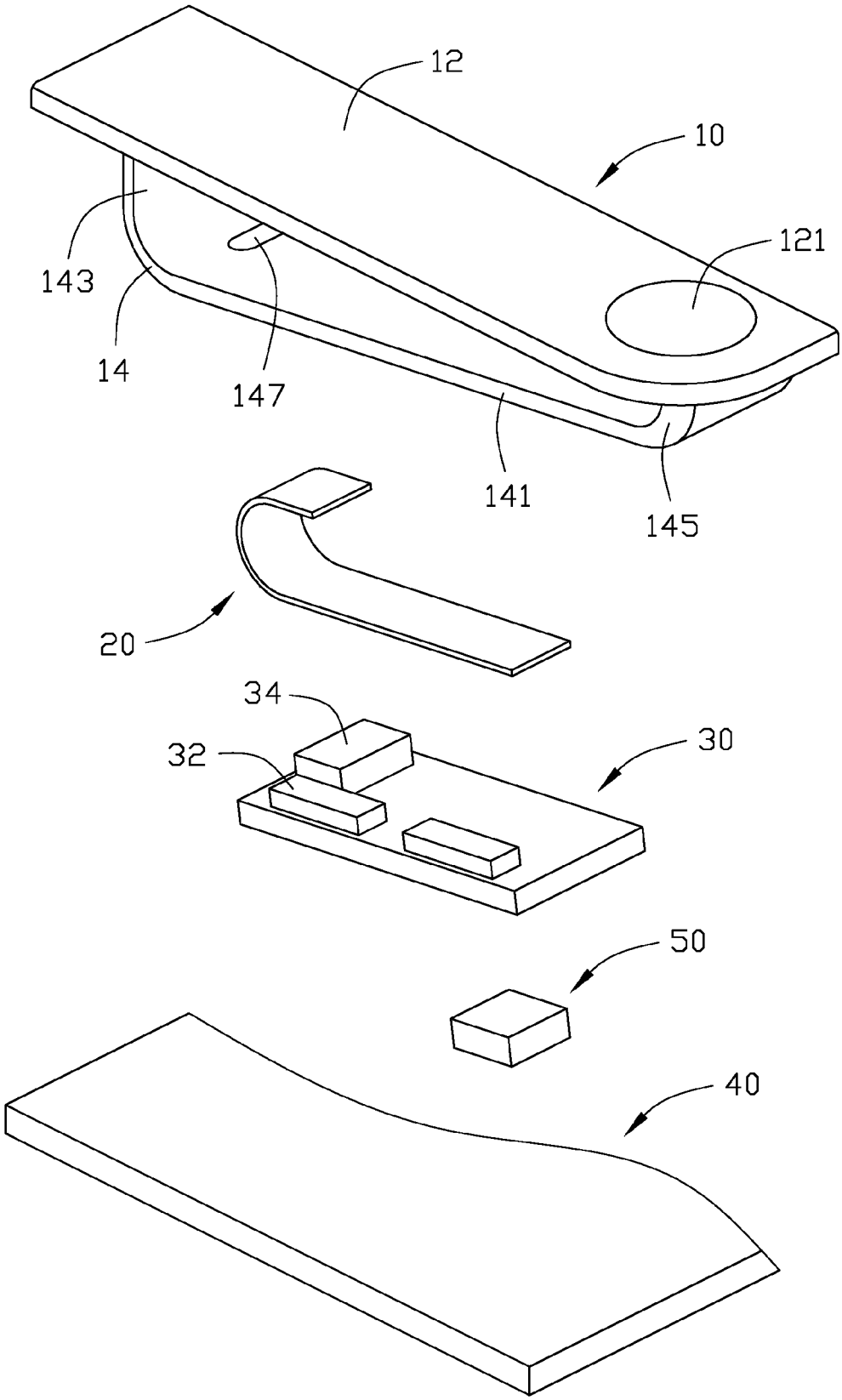
FIG. 1 is an exploded view of an embodiment of a reading light according to the present disclosure.

Referring to FIG. 1, an embodiment of a reading light includes a pressable member 10, a FPC (Flexible Printed Circuit) 20, a first PCB (printed circuit board) 30, and a second PCB 40.

The pressable member 10 can be used as a power button of the reading light. The pressable member 10 includes a transparent portion 12, and a supporting portion 14 connecting with the transparent portion 12. A circular recess 121 is defined in one end of the transparent portion 12. Then the circular finger recess 121 can be pressed to actuate the pressable member 10 if another end of the transparent portion 12 is pivotally attached to a portable electric device. The supporting portion 14 of the pressable member 10 includes a main section 141, a first connecting section 143, and a second connecting section 145. The first connecting section 143 is longer than the second connecting section 145. Thus, the main section 141 of the supporting portion 14 is slanted relative to the transparent portion 12. A notch 147 is defined in one end of the main section 141 adjacent to the first connecting section 143.

The FPC 20 can be used as a wiring member to electrically connect the first PCB 30 and the second PCB 40. The FPC 20 can have has properties of lightness, soft, thinness, smallness, ductility, flexibility and/or high wiring density, thereby saving space.

The first PCB 30 includes two LEDs 32 and coupled with a connector 34. The LEDs 32 are connected to the connector 34 via traces of the first PCB 30.

In one embodiment, the second PCB 40 is a motherboard of a notebook computer (not shown). The reading light can be applied to the notebook computer. When the notebook computer is in a standby state, a standby voltage (such as +5 VSB) retains on the motherboard. The standby voltage is generated from a battery of the notebook computer. The standby voltage on the second PCB 40 can be supplied to the LEDs 32 as a power supply of the LEDs 32.

Figure 2:
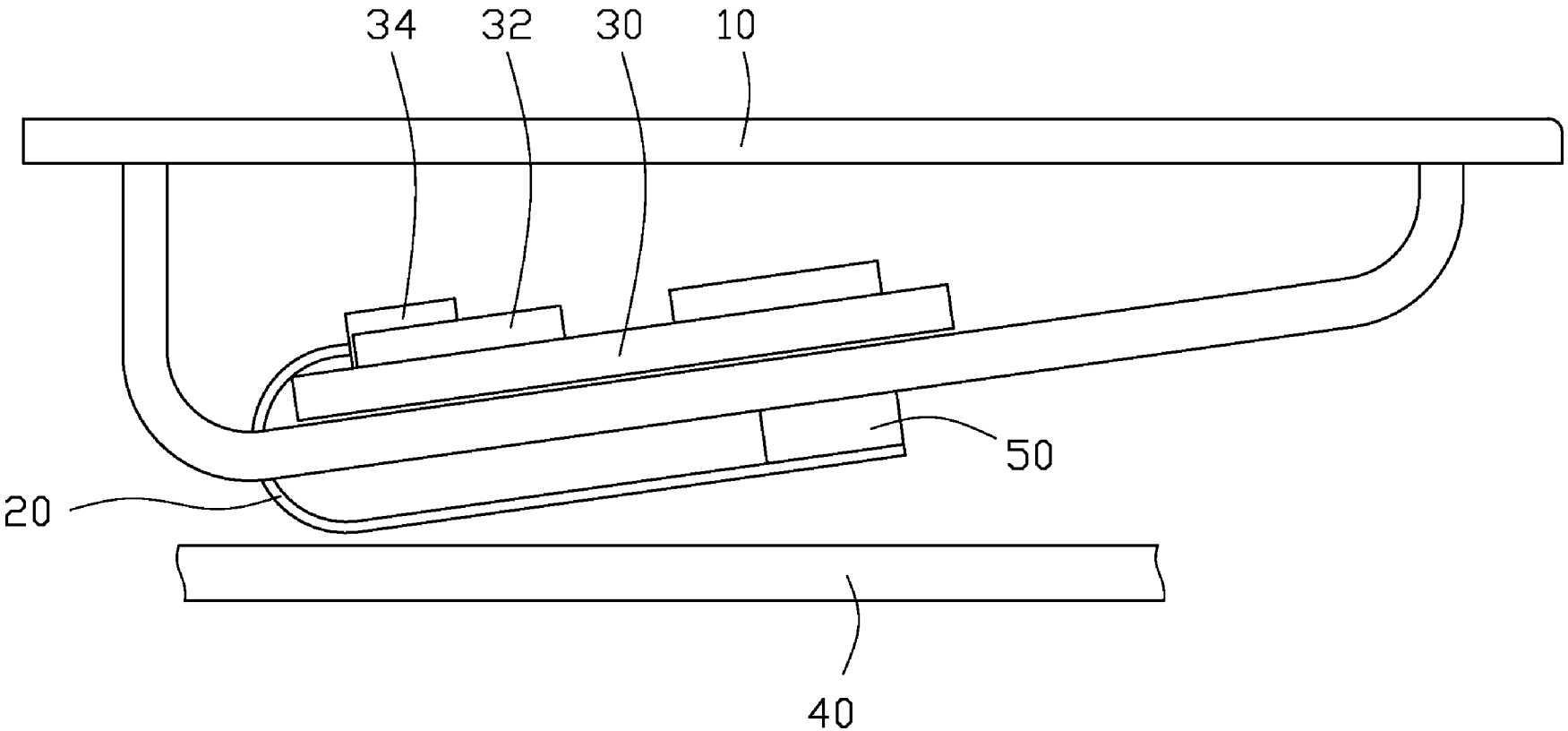
FIG. 2 an assembled view of FIG. 1.

Referring to FIG. 2, in assembly, the first PCB 30 is attached on the main section 141 of the supporting portion 14 of the pressable member 10. Then the first PCB 30 is located in a space surrounding by the transparent portion 12 and the supporting portion 14. One end of the FPC 20 is inserted through the notch 147 of the pressable member 10 and electrically connected with the connector 34 of the first PCB 30. Another end of the FPC 20 is attached to an exterior surface of the supporting portion 14 of the pressable member 10. A resilient member 50 is attached between the exterior surface of the supporting portion 14 and the another end of the FPC 20. The resilient member 50 may be a sponge, or a spring, etc. When the pressable member 10 is at a normal state, the FPC 20 and the second PCB 40 are not in contact with each other, and the LEDs 32 are electrically disconnected from the power signal (the standby voltage) on the second PCB 40 and in a power off state.

Figure 3:
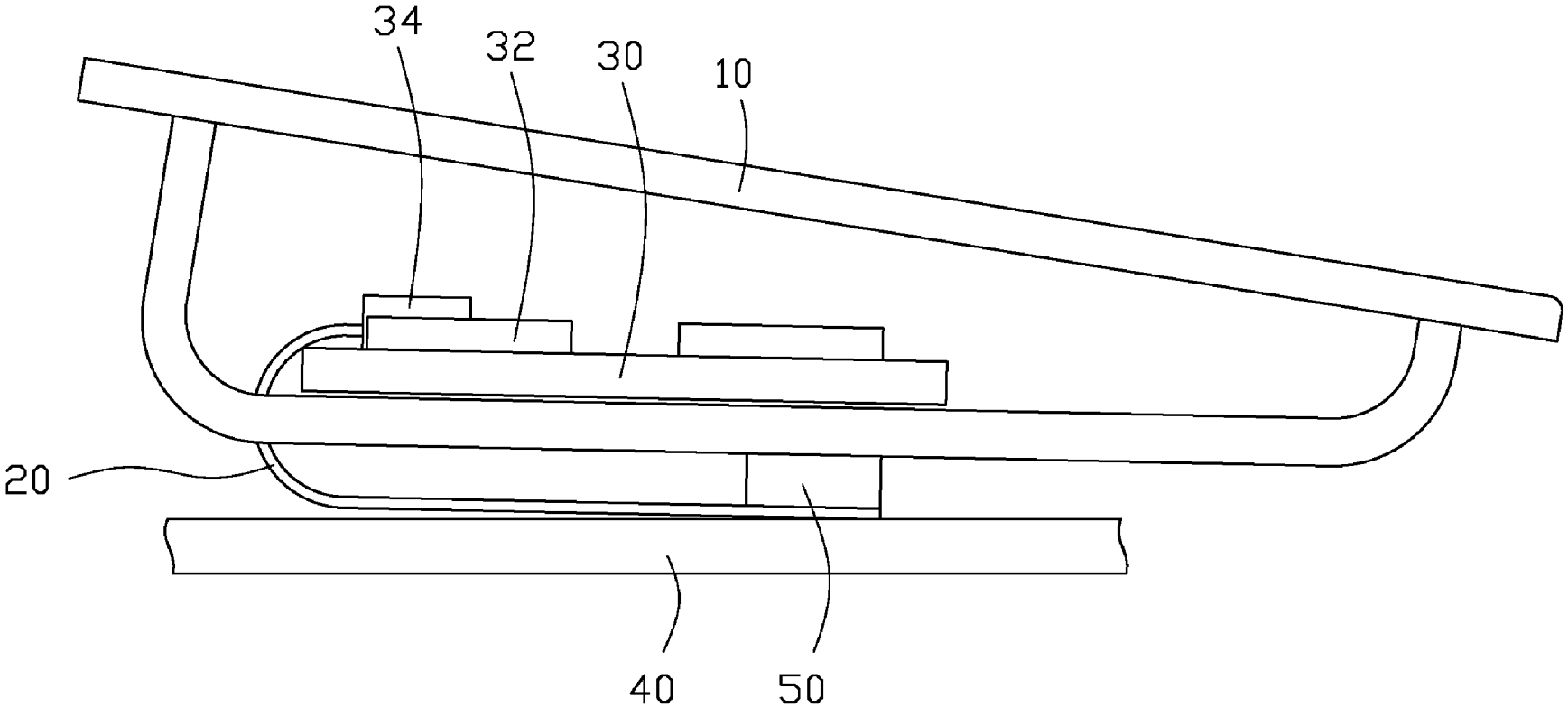
FIG. 3 is similar to FIG. 2, but showing a pressable member of the reading light at a depressed state.

Referring to FIG. 3, if one end of the pressable member 10 is fixed pivotally, another end of the pressable member 10 is movable to a depressed state. The supporting portion 14 of the pressable member 10 depresses the resilient member 50 and the external end of the FPC 20. The external end of the FPC 20 electrically contacts with the second PCB 40 and electrically connects to the standby voltage on the second PCB 40. Thus, the LEDs 32 is powered on and emits light that travels through the transparent portion 12 of the pressable member 20.

In the embodiment, the second PCB 40 and the FPC 20 can both define golden finger mating with each other. Thus, the standby voltage can be supplied to the LEDs 32 via traces of the second PCB 40, the mated golden finger, the FPC 20, the connector 34, and traces of the first PCB 30.

The reading light can be attached to the notebook at a side flange of the LCD (Liquid Crystal Display) or the keyboard thereof. Thus, when the notebook is closed and in the standby state, the reading light can be used as a private light source to read books, magazines without disturbing others. The reading light utilizes the LEDs 32 capable of emitting gentle light ray for protecting eyesight of the user.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A reading light comprising:

a first printed circuit board with a connector attached thereon;

a light emitting diode (LED), attached to the first printed circuit board, capable of emitting light;

a pressable member capable of transmitting light emitted by the LED; and a flexible printed circuit board capable of transmitting power to the LED;

wherein a first end of the flexible printed circuit board is electrically connected to the connector; when the pressable member is at a normal state, the flexible printed circuit is not coupled to a power supply, and the LED is powered off; when the pressable member is at a depressed state, a second end of the flexible printed circuit, opposite to the first end, is electrically connected to the power supply.

2. The reading light of claim 1, wherein the pressable member comprises a transparent portion and a supporting portion; the first printed circuit board is attached on the supporting portion and located in a space surrounded by the transparent portion and the supporting portion.

3. The reading light of claim 2, wherein the first end and the second end of the flexible printed circuit board are at opposite sides of the supporting portion.

4. The reading light of claim 3, wherein a resilient member is located between the supporting portion and the second end of the flexible printed circuit board.

5. The reading light of claim 2, wherein the supporting portion of comprises a main section, a first connecting section, and a second connecting section located between the main section and the transparent portion of the pressable member.

6. The reading light of claim 5, wherein the first connecting section is longer than the second connecting section, and the main section is at an angle relative to the transparent portion.

7. The reading light of claim 1, further comprising a second printed circuit board, the second printed circuit board provides a conduit for supplying power.

8. A reading light comprising:

a pressable member;

a first printed circuit board with at least one light emitting diode (LED) mounted thereon, and the first printed circuit board mounted in the pressable member;

a second printed circuit board capable of supplying a power supply for the LED; and a flexible printed circuit board capable of connecting the first printed circuit board and the second printed circuit board; the flexible printing circuit board having a first end connected to the LED, and the pressable member is pivotable relative to the second printed circuit board to bias a second end of the flexible printing circuit board opposite to the first end electrically connecting to or disconnecting from the power supply.

9. The reading light of claim 8, wherein the pressable member is capable of urging the second end of the flexible printed circuit board into contact with the second printed circuit board in a depressed state.

10. The reading light of claim 9, wherein the pressable member comprises a transparent portion and a supporting portion, the first printed circuit board is attached on the supporting portion and located in a space defined by the transparent portion and the supporting portion.

11. The reading light of claim 10, wherein the first end of the flexible printed circuit board is at an inner side of the supporting portion, and the second end of the flexible printed circuit board is at an outer side of the supporting portion.

12. The reading light of claim 10, wherein a resilient member is located between the supporting portion and the second end of the flexible printed circuit board.

13. The reading light of claim 10, wherein the supporting portion comprises a main section, a first connecting section, and a second connecting section connecting the main section and the transparent portion.

14. The reading light of claim 13, wherein the first connecting section is longer than the second connecting section, and the main section is at an angle relative to the transparent portion.

15. The reading light of claim 9, wherein a circular finger recess is defined at one end of the pressable member.

* * * * *